US011287205B2

(12) United States Patent
Biegel

(10) Patent No.: US 11,287,205 B2
(45) Date of Patent: Mar. 29, 2022

(54) TRIGGER ASSEMBLY

(71) Applicant: CMC Triggers Corp., Fort Worth, TX (US)

(72) Inventor: Jack Richard Biegel, Mansfield, TX (US)

(73) Assignee: CMC Triggers Corp., Fort Worth, TX (US)

( * ) Notice: Subject to any disclaimer, the term of this patent is extended or adjusted under 35 U.S.C. 154(b) by 0 days.

(21) Appl. No.: 17/151,283

(22) Filed: Jan. 18, 2021

(65) Prior Publication Data

US 2021/0270556 A1 Sep. 2, 2021

Related U.S. Application Data

(60) Provisional application No. 62/963,202, filed on Jan. 20, 2020.

(51) Int. Cl.

| | |
|---|---|
| ***F41A 19/10*** | (2006.01) |
| ***F41A 19/43*** | (2006.01) |
| ***F41A 19/15*** | (2006.01) |
| ***F41A 19/12*** | (2006.01) |
| ***F41A 17/46*** | (2006.01) |

(52) U.S. Cl.

CPC ..... *F41A 19/10* (2013.01); *F41A 17/46* (2013.01); *F41A 19/12* (2013.01); *F41A 19/15* (2013.01); *F41A 19/43* (2013.01)

(58) Field of Classification Search

CPC ..... F41A 19/10; F41A 19/43; F41A 19/15; F41A 19/12; F41A 17/46

See application file for complete search history.

(56) References Cited

U.S. PATENT DOCUMENTS

| | | | | | |
|---|---|---|---|---|---|
| 3,847,054 | A * | 11/1974 | Ruger | F41A 19/02 | 89/129.02 |
| 5,758,444 | A * | 6/1998 | Ruger | F41A 3/32 | 42/16 |
| 6,722,072 | B1 | 4/2004 | McCormick | | |
| D504,168 | S | 4/2005 | McCormick | | |
| 7,162,824 | B1 | 1/2007 | McCormick | | |
| 7,293,385 | B2 | 11/2007 | McCormick | | |
| 8,590,197 | B1 * | 11/2013 | Sylvester | F41A 3/72 | 42/16 |
| 10,989,489 | B2 * | 4/2021 | Downey | F41A 17/52 | |
| 11,029,114 | B2 * | 6/2021 | McDonald | F41A 19/07 | |
| 2020/0182575 | A1 * | 6/2020 | Barrett | F41A 19/14 | |

* cited by examiner

*Primary Examiner* — Joshua T Semick

(74) *Attorney, Agent, or Firm* — Wood Herron & Evans LLP

(57) ABSTRACT

Provided is a trigger mechanism having a trigger member is pivotally supported by a housing and having a forwardly extending finger portion and an actuation blade portion and a sear fixed in position relative to each other. A hammer pivotally supported inside the housing has a tooth and a disconnector has hook portion. A safety selector movable between safe and fire positions has a first surface that confronts the finger portion to block pivotal movement of the trigger member when in the safe position and a recess that receives the finger portion and allows movement of the trigger member when in the fire position. When the trigger member is pulled, cycling of the firearm action pivots the hammer to engage the tooth with the hook portion and hold the hammer until the trigger member is released to allow the sear to engage the hammer as the hook releases the tooth.

6 Claims, 8 Drawing Sheets

TRIGGER ASSEMBLY

RELATED APPLICATIONS

This application claims priority to U.S. Provisional Patent Application No. 62/963,202, filed Jan. 20, 2020, and incorporates the same herein by reference.

TECHNICAL FIELD

This invention relates to a trigger assembly for a semi-automatic firearm. More particularly, it relates to a trigger assembly in a trigger housing with an integrated bolt hold-open mechanism.

BACKGROUND

The Ruger™ Model 10-22™ semi-automatic, rimfire rifle (manufactured by Sturm, Ruger and Co. of South Fairfield, Conn.) is one of the most popular models of its type used in the United States today. Its design is very functional, reliable, and economical to manufacture, however various improvements could be made to certain of its components. Many clones of the 10-22™ pattern firearm are available on the market and have contributed to the popularity of the design.

The Ruger 10-22™ uses a trigger module assembled in a housing that is attachable as a unit to the receiver. The trigger assembly has been generally unchanged since it was first introduced in 1964, until recently when Ruger introduced an improved BX™ trigger design. This improved design still has certain shortcomings that can be improved upon.

SUMMARY OF THE INVENTION

The present invention provides a trigger assembly with an improved trigger/sear/disconnector mechanism, an improved bolt hold-open mechanism, and an improved magazine release user interface.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWINGS

Like reference numerals are used to indicate like parts throughout the various drawing figures, wherein.

DETAILED DESCRIPTION

Figure 1:
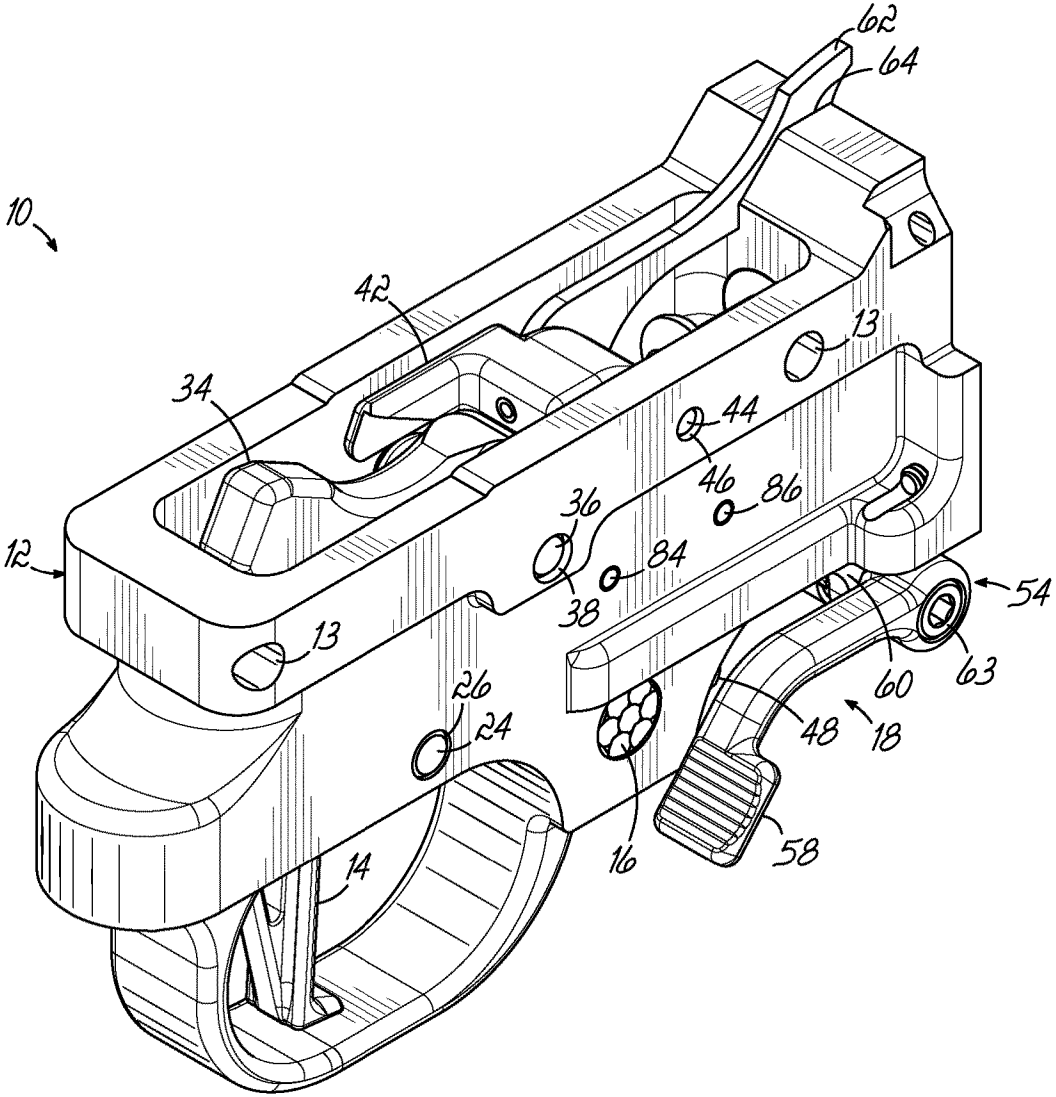
FIG. 1 is an isometric view of a trigger assembly according to one embodiment of the present invention.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus, appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments. "Forward" will indicate the direction of the muzzle and the direction in which projectiles are fired, while "rearward" will indicate the opposite direction. "Lateral" or "transverse" indicates a side-to-side direction generally perpendicular to the axis of the barrel. Although firearms may be used in any orientation, "left" and "right" will generally indicate the sides according to the user's orientation, "top" or "up" will be the upward direction when the firearm is gripped in the ordinary manner.

Figure 2:
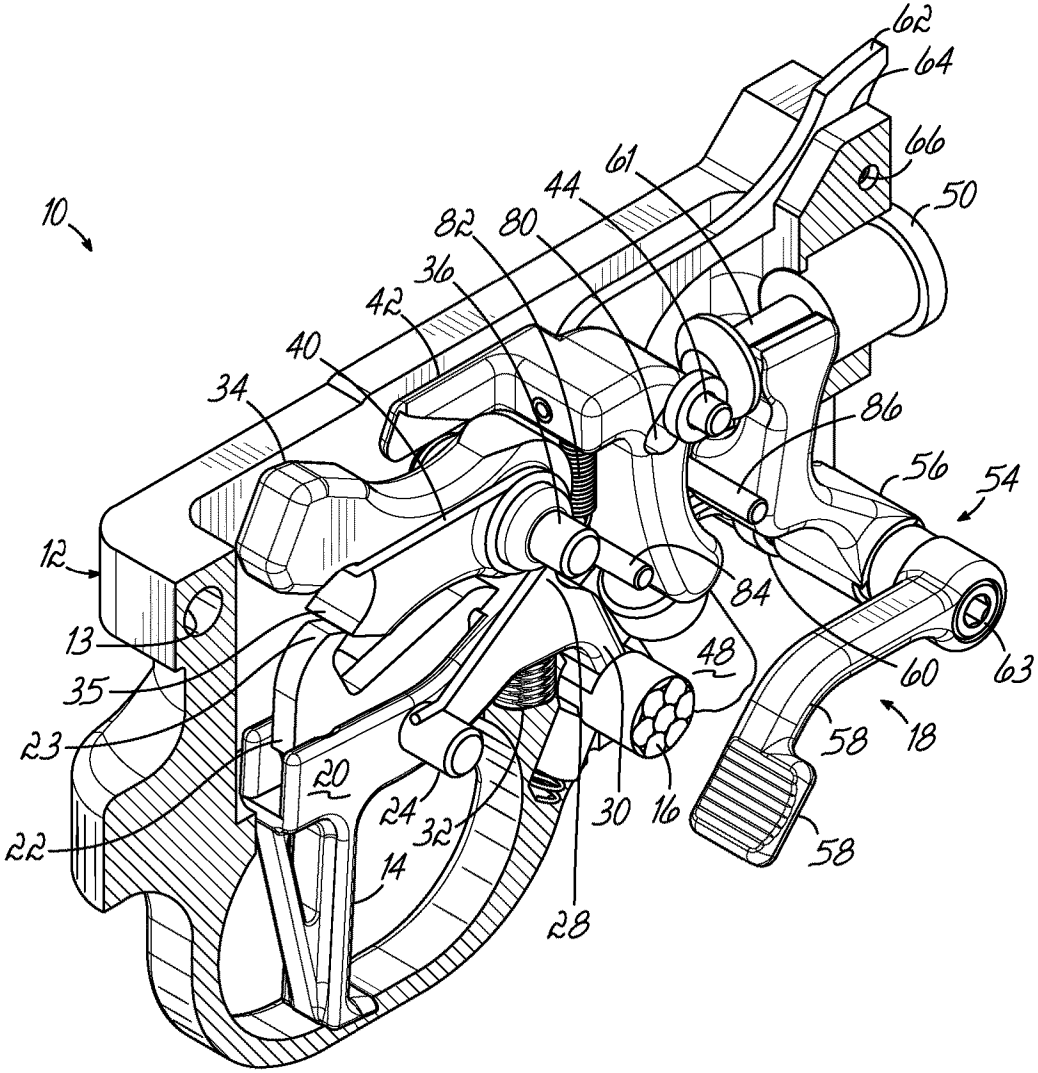
FIG. 2 is a similar view with the trigger housing cut-away to show internal parts.

Referring first to FIGS. 1 and 2, therein is shown a trigger assembly 10 according to an embodiment of the present invention. The trigger assembly 10 includes a housing 12 that, in this embodiment, is configured to mate with the receiver and other parts of a Ruger™ 10-22™ pattern firearm. It is attachable to the receiver by way of assembly pins (not shown in FIG. 1) that extend through mounting openings 13 in the housing 12 and aligned corresponding openings in the receiver (not shown in FIG. 1). The user interface of the trigger blade 14 (the part if the trigger actuated by the user's finger) and cross-bolt safety 16 are in the positions well known to a user of this pattern. Also mounted on the housing 12 is the user interface 18 for releasing the ammunition magazine. This user interface 10, as well as the internal trigger mechanism and bolt hold-open, differ significantly from the original design, as will be explained in greater detail below.

Inside the housing 12, a trigger member 20 and disconnector 22 are pivotally mounted on a pivot pin 24 that is supported by oppositely aligned openings 26 in the housing 12. The disconnector 22 pivots independently of the trigger member 20 in a limited range of motion. A forward portion of the trigger member 20 includes the sear 28 and a finger 30 extending forwardly and downwardly to interface with the cross-bolt of the safety 16 mechanism. The trigger member 20 is biased toward a "set" position by the trigger spring 32. The disconnector 22 is spring biased (not shown in this view), as will be described in greater detail later.

The hammer 34 is also pivotally mounted on a transverse pin 36 that is supported in laterally opposed openings 38 in the housing 12. The hammer 34 is held in the "set" position by engagement with the sear 28 of the trigger member 20 and is biased toward a released position by a helical hammer spring 40.

A bolt hold-open lever 42 is in the general form of a crank arm, pivotally mounted on a pivot pin 44 supported in opposite openings 46 in the housing 12. The hold-open lever 42 is biased downward, away from engagement with the bolt, by a spring 82. A user may manually actuate the hold-open lever 42 by pressing a button 48 that is also supported by the housing 12. Operation of the bolt hold-open mechanism will be discussed in greater detail below.

Carried in the forward wall of the housing 12 is a magazine retention member 50 of ordinary design for the 10-22™ pattern firearm. The retention member 50 is biased forward by a helical spring 52 to engage a magazine (not shown) in the well-known manner. The retention member 50 may be moved out of engagement with the magazine by movement of the release lever mechanism 54. The release lever mechanism 54 includes a release lever 56 and actuation lever 58 that pivot together on downwardly extending flanges 60 of the housing 12.

Additionally, the trigger assembly 10 includes an ejector member 62 position near the top and left lateral side of the housing 12. The ejector member 62 is mounted at a rearward end on the pivot axis 44 for the bolt hold-open lever 42 in a well-known manner and rests in a slot 64 provided in the upper forward wall of the housing 12. Unlike the prior design, which allows the ejector member 62 to pivot freely on the pivot pin 44 out of engagement with the slot 64, the present design uses a roll pin 66 that extends through corresponding transverse openings in the housing 12 and ejector member 62 to retain it in place.

Figure 4:
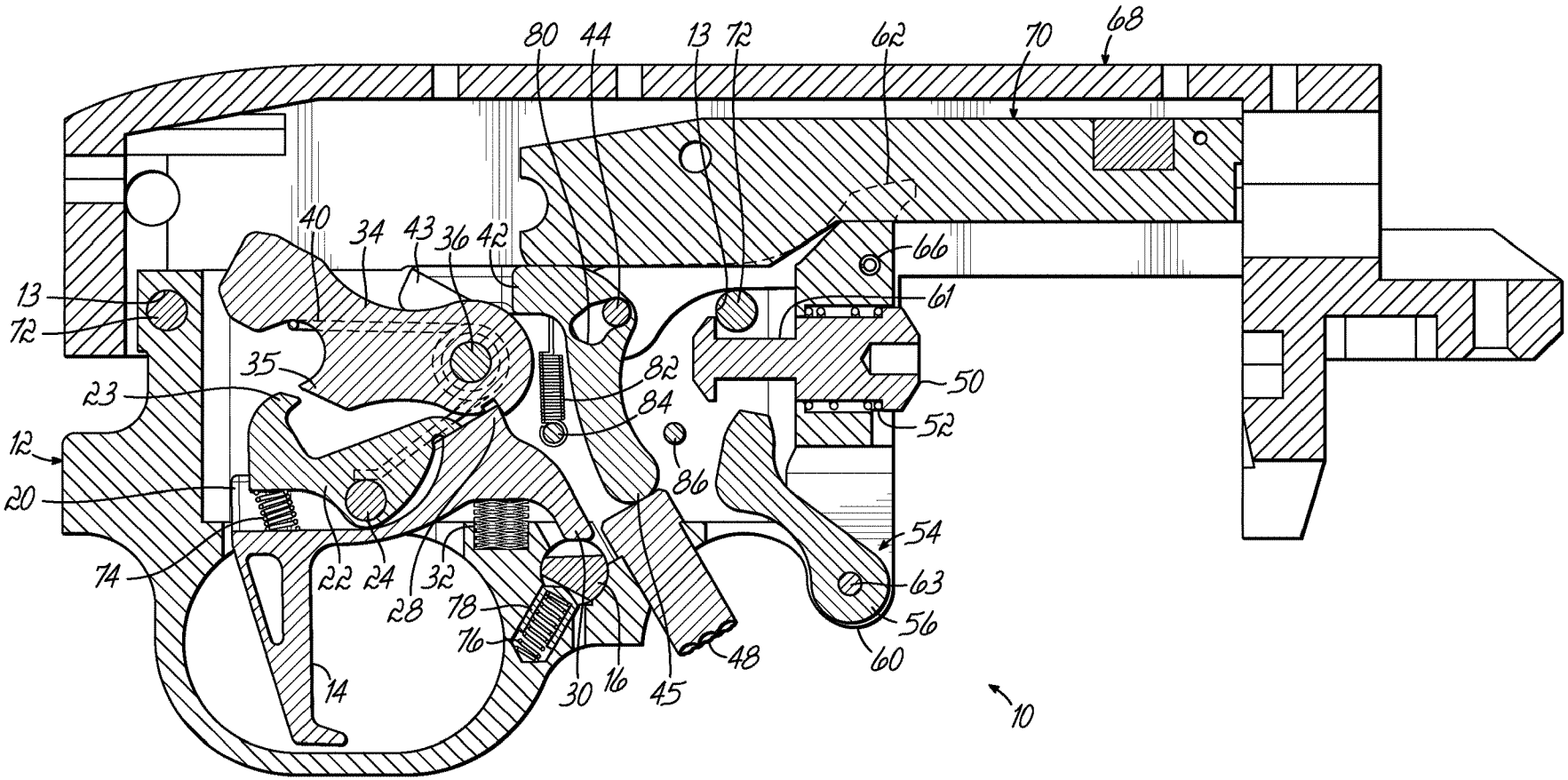
FIG. 4 is a side sectional view of the trigger assembly, receiver, and bolt showing the trigger in the set position and bolt closed.

Referring now to FIG. 4, therein is shown a longitudinal sectional view of the trigger assembly 10 mounted to a receiver 68, which houses a longitudinally reciprocating bolt 70. The illustrated receiver end 68 and bolt 70 are of the standard 10-22 pattern. The trigger assembly housing 12 attaches to the receiver 68 with transverse assembly pins 72 through mounting opening 13 in the trigger housing 12 and corresponding openings (not labeled) in the receiver 68 in the well-known manner. In FIG. 4, the parts of the trigger assembly 10 is shown in the "set" position in which the trigger member 20 is biased by the trigger spring 32 with its sear 28 engaging the hammer 34 and holding it against pressure exerted by the hammer spring 40. The disconnector 22 is pivotally biased by the disconnector spring 74, which fits within the trigger member 20. The bolt 70 is shown in its closed position. The cross-bolt safety member 16 is transversely movable between "safe" and "fire" positions, biased in each by a spring detent 76, 78. When in the "safe" position, the finger 30 of the trigger member 20 is blocked, preventing pivotal movement of the trigger member 20. When in the "fire" position, the finger 30 can move into a recess or notch in the safety member 16 (shown in FIG. 2) and allows the trigger member 20 to rotate (illustrated in FIGS. 5 and 7).

Figure 3:
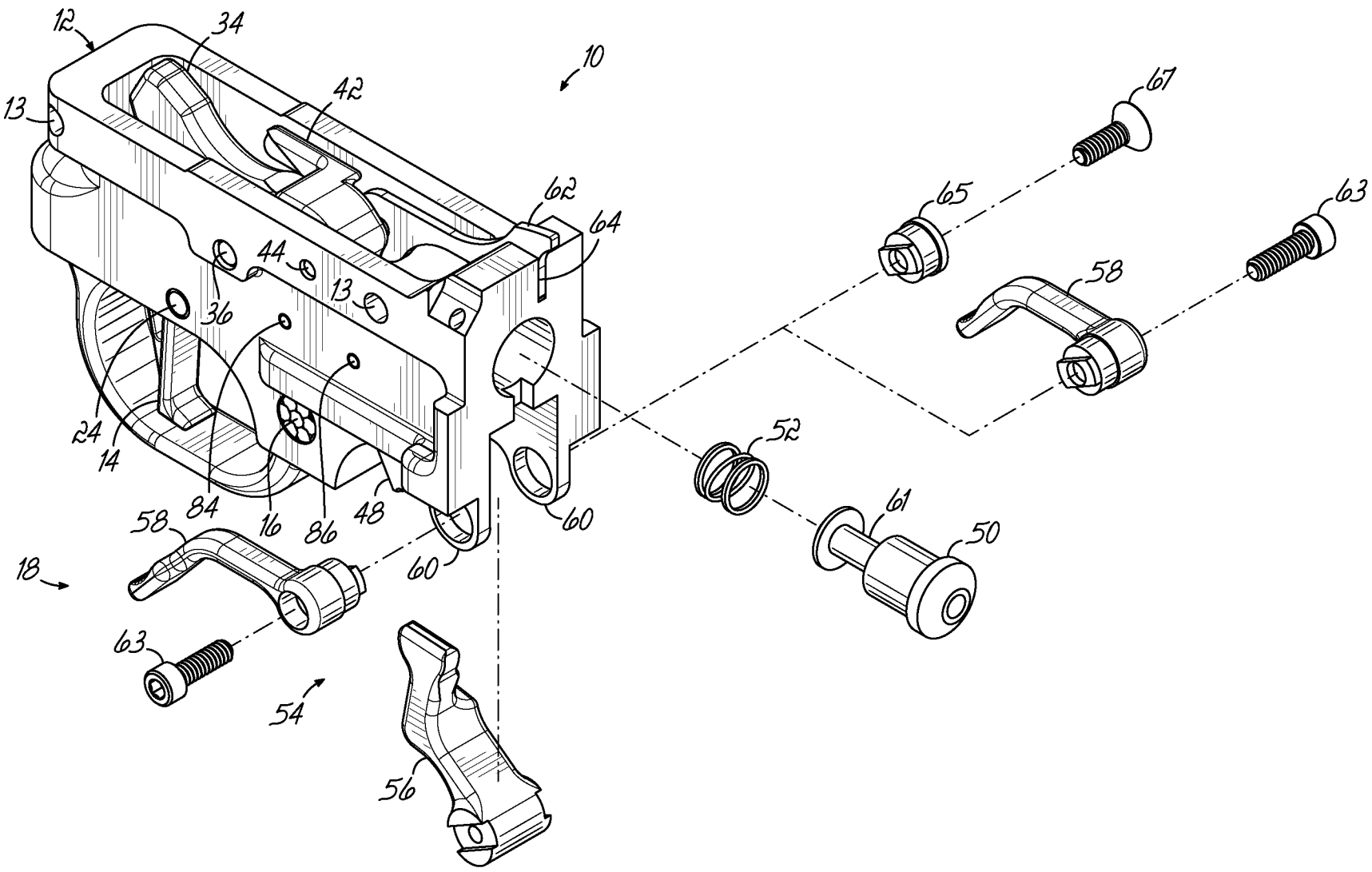
FIG. 3 is another isometric view with parts of the magazine release mechanism exploded from the housing.

Referring again to FIG. 3, the magazine release lever 56 is pivotally supported by the flanges 60. An upper end of the release lever 56 engages an annular groove 61 in the magazine retention member 50 to translate pivotal movement of the lever 56 to longitudinal linear movement of the retention member 50. The actuation lever 58 connects to the release lever 56 with a non-round interface so as to transfer pivotal motion. The actuation lever 58 is secured by a threaded fastener 63. On the opposites side, an end cap 65, secured to the lever 56 with a fastener 67, can be used to pivotally support the lever 56. According to one embodiment of the invention, the actuation lever 58 is reversible and can be attached to the release lever 56 on either the left or right side (reversing with the end cap 65 and fastener 67) at the user's choice. Or if desired, a second actuation lever 58 may be attached on the opposite side so as to make the magazine release user interface 18 fully ambidextrous.

Figure 5:
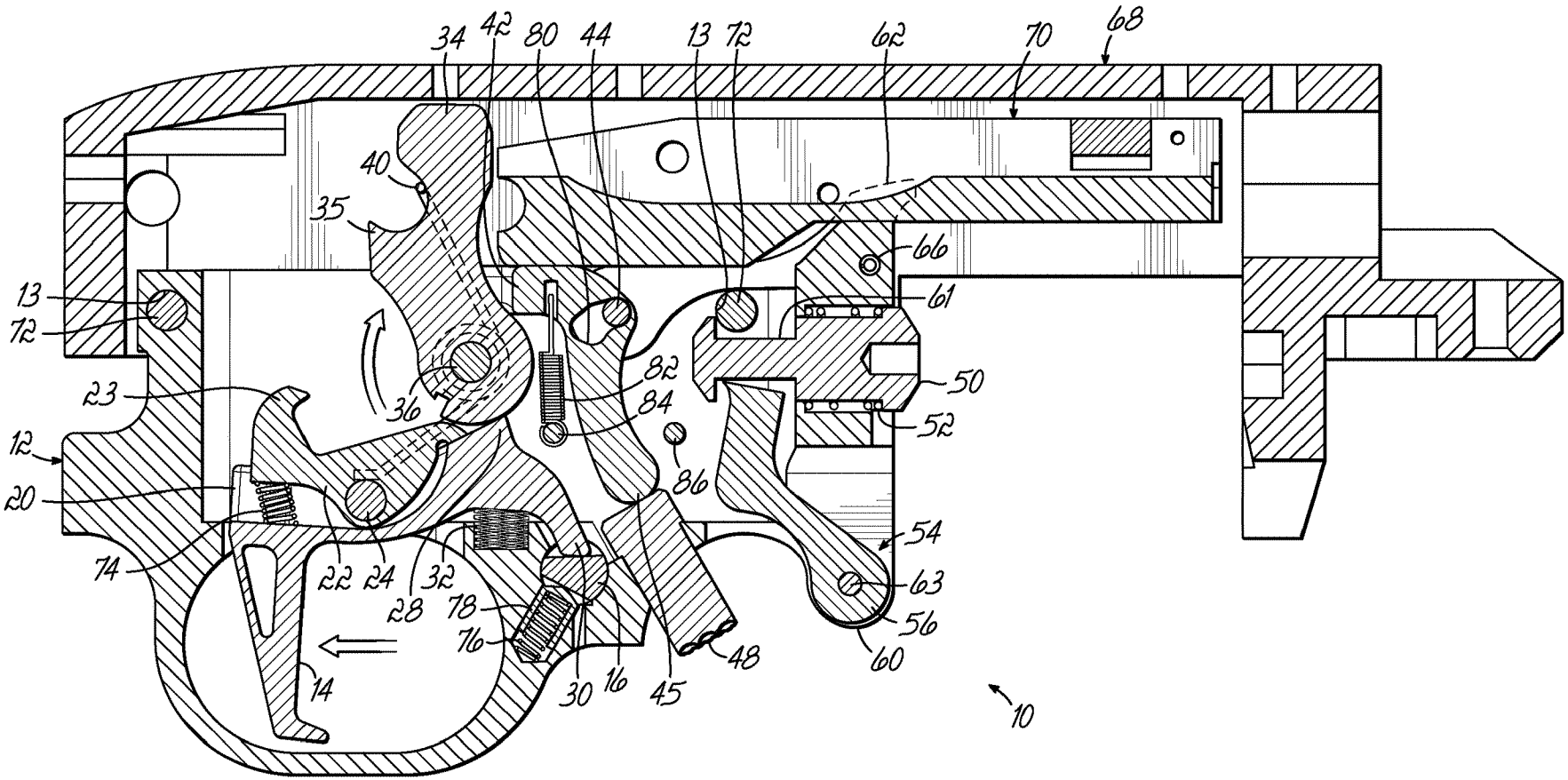
FIG. 5 is a similar view showing the trigger pulled and hammer dropped.

Referring now to FIG. 5, therein the trigger member 20 is shown pivoted to the release or "fired" position against the force of the trigger spring 32. This movement disengages the sear 28 from the hammer 34, allowing the hammer 34 to pivot into contact with the firing pin (not shown) carried by the bolt 70. This causes a cartridge to discharge and, by blow-back force, the bolt 70 longitudinally reciprocates toward the rear of the receiver 68.

Figure 6:
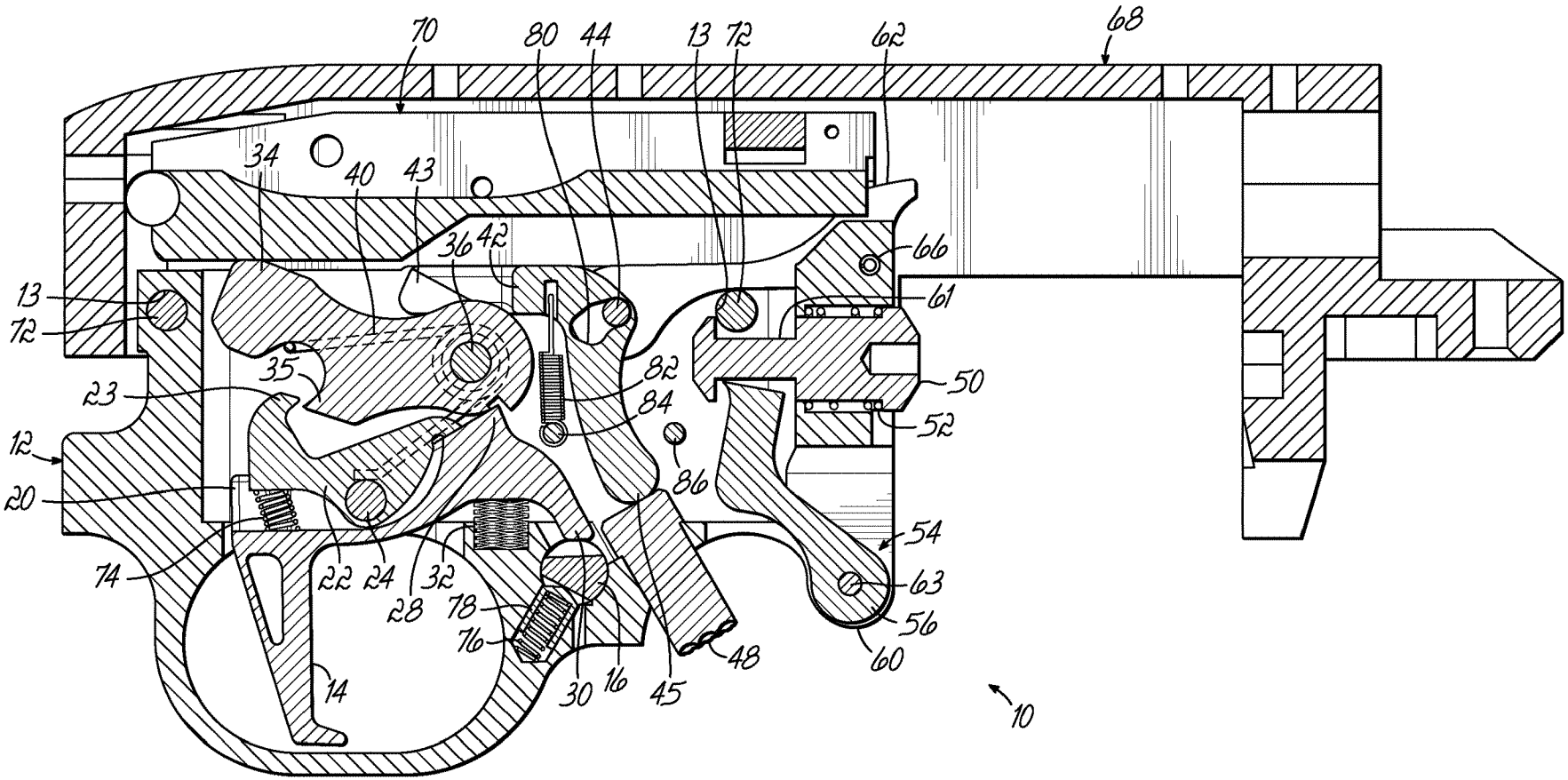
FIG. 6 is a similar view showing the bolt in a fully retracted position.

FIG. 6 shows the bolt 70 longitudinally reciprocated to its rearmost position in the receiver 68. This movement forces the hammer 34 to pivot back toward or beyond the "set" position. If the trigger member 20 was still in the "pulled" position, the disconnector 22 would hold the hammer 34 until the trigger member 20 is released, at which time the sear 28 will engage and hold the hammer 34.

Figure 7:
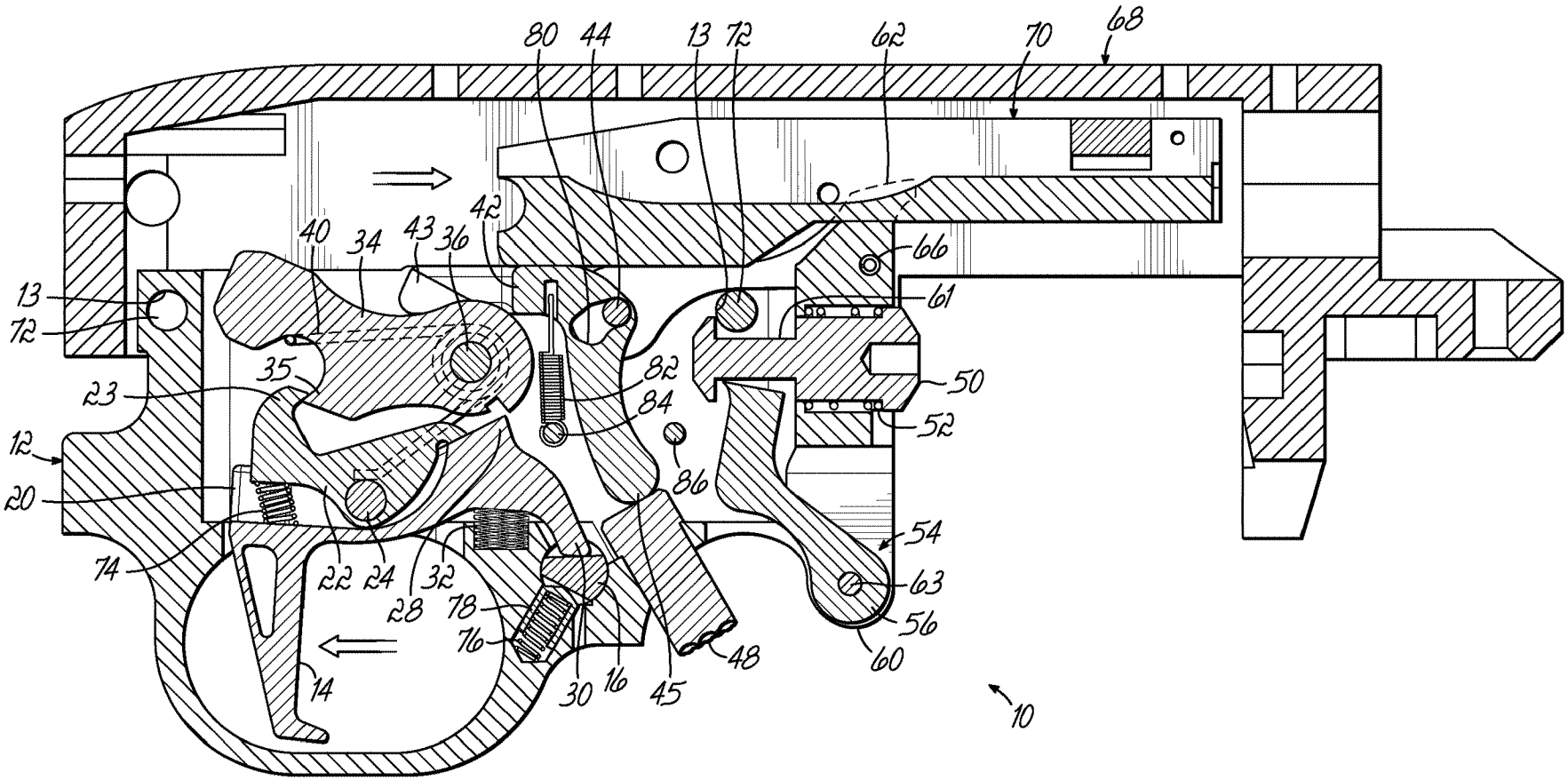
FIG. 7 is a similar view showing the triggers held in a pulled position and the disconnector holding the hammer cocked while the bolt has returned to the closed position.

FIG. 7 shows the trigger 14, 20 being held in the "pulled" position after the bolt 70 has returned to the closed position. The disconnector hook 23 is engaged with a tooth 35 on the hammer 34 and holding the hammer 34 before the sear 28 has engaged the hammer 34. When the trigger 14, 20 is released, the sear 28 will engage the hammer 34 and hold it in the cocked position as the disconnector 22 disengages from the hammer 34 and the mechanism will return to the reset and cocked condition shown in FIG. 4.

Figure 8:
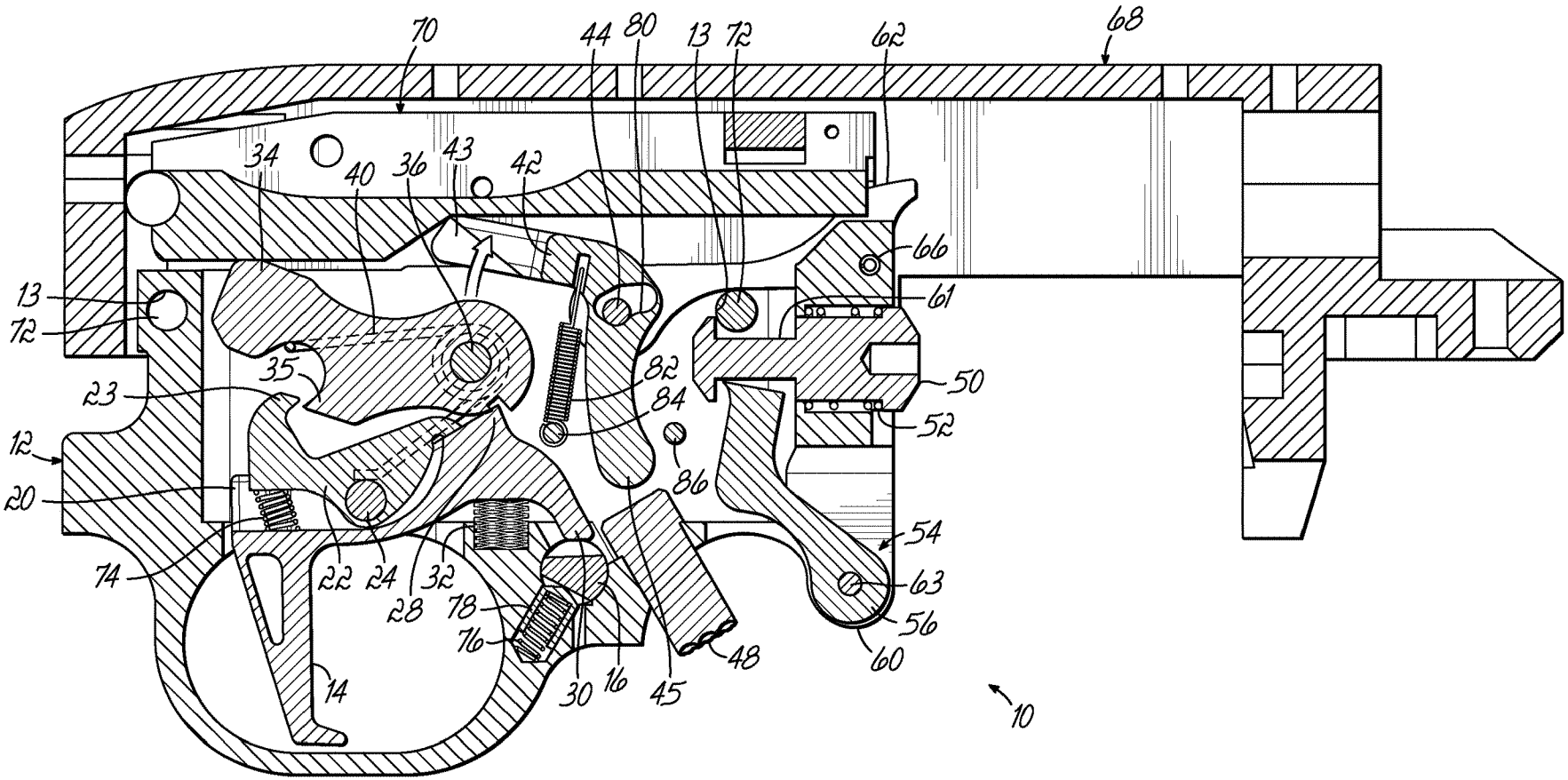
FIG. 8 is a similar view showing the bolt in a locked open position.

FIG. 8 shows the bolt 70 in the locked-back position. Here, the bolt 70 is held by the bolt hold-open lever 42, which has been pivoted/moved into the position shown to block forward movement of the bolt 70 with an upper arm portion 43. The button 48 moves linearly and contacts a lower arm portion 45 of the lever 42. Rotational movement of the hold-open lever 42 is limited by limit pins 84, 86 carried by the housing 12. The pivot opening 80 in the hold-open lever 42 is enlarged or slotted to allow shifting on the pivot pin 44 when lifted by the button 48. This shifting causes the hold-open lever to stay in the blocking position against the force of the bolt 70 and bias of the return spring 82 after pressure on the button 48 has been released. When the bolt 70 is manually retracted a short distance, engagement with the hold-open lever 42 is released and the spring 82 returns the lever 42 back to its resting position (as shown in FIGS. 4-7). The return spring 82 may be anchored to, for example, the rear limit pin 84.

While one or more embodiments of the present invention have been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A firearm trigger mechanism, comprising;

a housing;

a trigger member pivotally supported by the housing, the trigger member having an actuation blade portion and a sear that are fixed in position relative to each other and having a forwardly extending finger portion;

a hammer pivotally supported inside the housing and having a tooth;

a disconnector pivotably mounted on the trigger member to pivot on a common axis with the trigger member and having hook portion; and a safety selector supported by the housing and movable between safe and fire positions, the safety selector having a first surface that confronts the finger portion to block pivotal movement of the trigger member when the selector is in the safe position and having a recess that receives the finger portion and allows movement of the trigger member when the selector is in the fire position, wherein when the trigger member is pulled, cycling of the firearm action pivots the hammer to engage the tooth with the hook portion and hold the hammer until the trigger member is released to allow the sear to engage the hammer as the hook releases the tooth.

2. The trigger mechanism of claim 1, wherein the safety selector includes a transversely slidable cross-bolt member supported by the housing.

3. A firearm trigger mechanism, comprising;

a housing;

a trigger member pivotally supported by the housing, the trigger member having an actuation blade portion and a sear that are fixed in position relative to each other and having a forwardly extending finger portion;

a hammer pivotally supported inside the housing and having a tooth;

a disconnector pivotably mounted on the trigger member to pivot on a common axis with the trigger member and having hook portion; and a safety selector supported by the housing and movable between safe and fire positions, the safety selector having a first surface that confronts the finger portion to block pivotal movement of the trigger member when the selector is in the safe position and having a recess that receives the finger portion and allows movement of the trigger member when the selector is in the fire position, wherein when the trigger member is pulled, cycling of the firearm action pivots the hammer to engage the tooth with the hook portion and hold the hammer until the trigger member is released to allow the sear to engage the hammer as the hook releases the tooth; and further comprising a bolt hold-open member and an actuation plunger, the bolt hold-open member being pivotally mounted within the housing for movement between blocking and nonblocking positions, the hold-open member including a crank arm with first and second extensions, the first extension configured to block a firearm bolt in an open position when the member is in the blocking position;

the actuation plunger slidably situated in the housing for linear manual manipulation to engage the second extension to cause the hold-open member to pivot from the nonblocking position to the blocking position against spring bias.

4. A firearm trigger mechanism, comprising;

a housing;

a trigger member pivotally supported by the housing, the trigger member having an actuation blade portion and a sear that are fixed in position relative to each other and having a forwardly extending finger portion;

a hammer pivotally supported inside the housing and having a tooth;

a disconnector pivotably mounted on the trigger member to pivot on a common axis with the trigger member and having hook portion; and a safety selector supported by the housing and movable between safe and fire positions, the safety selector having a first surface that confronts the finger portion to block pivotal movement of the trigger member when the selector is in the safe position and having a recess that receives the finger portion and allows movement of the trigger member when the selector is in the fire position, wherein when the trigger member is pulled, cycling of the firearm action pivots the hammer to engage the tooth with the hook portion and hold the hammer until the trigger member is released to allow the sear to engage the hammer as the hook releases the tooth; and wherein the housing includes a magazine release mechanism with:

a magazine retention member;

a release lever pivotally mounted on a downwardly extending support flange of the housing and configured to operate the magazine retention member;

an actuation lever separate from and securable to the release lever, the actuation lever extending rearward laterally outboard of one side of the housing.

5. The trigger mechanism of claim 4, wherein the actuation lever is reversibly securable to the release lever to be situated on either of opposite lateral outboard sides of the housing.

6. The trigger mechanism of claim 4, further comprising a second actuation lever securable to the release lever situated on the other lateral outboard side of the housing.

* * * * *